United States Patent [19]

Fox

[11] 4,293,312

[45] Oct. 6, 1981

[54] COMBUSTIBLE COMPOSITIONS AND PROCESSES FOR THEIR PRODUCTION

[75] Inventor: Rodney T. Fox, North Humberside, England

[73] Assignee: Reckitt & Colman Products Limited, England

[21] Appl. No.: 173,615

[22] Filed: Jul. 30, 1980

[30] Foreign Application Priority Data

Aug. 2, 1979 [GB] United Kingdom ..... 26915/79

[51] Int. Cl.[3] ..... C10L 7/02; C10L 11/02

[52] U.S. Cl. ..... 44/1 R; 44/7 D; 44/16 R; 44/21

[58] Field of Search ..... 44/16 R, 21, 20, 25, 44/24, 41, 7 D, 1 R

[56] References Cited

U.S. PATENT DOCUMENTS

| | | | |
|---|---|---|---|
| 563,162 | 6/1896 | Gontner et al. | 44/21 |
| 3,338,691 | 8/1967 | Knowles et al. | 44/40 |
| 3,346,352 | 10/1967 | McCoy et al. | 44/41 X |
| 3,540,865 | 11/1970 | Pape | 44/41 X |
| 4,083,697 | 4/1978 | Smith et al. | 44/25 X |

*Primary Examiner*—Carl F. Dees

*Attorney, Agent, or Firm*—Bacon & Thomas

[57] ABSTRACT

An ignitable combustible composition comprising a matrix of solid resin having distributed therethrough combustible liquid, e.g. kerosene, water and contains also up to 25% by weight of a particulate non-combustible solid having a specific surface area of not greater than 8 $m^2/g$ e.g. sand, glass microspheres, or kieselguhr, to lengthen the burning time of a unit volume of the composition.

10 Claims, No Drawings

COMBUSTIBLE COMPOSITIONS AND PROCESSES FOR THEIR PRODUCTION

FIELD OF THE INVENTION

The present invention relates to combustible compositions and includes compositions which in relatively small size pieces are useful as firelighters and in larger pieces are suitable as firelogs, but which may be used as fuel.

BACKGROUND OF THE INVENTION

A widely used type of firelighter is the so-called "white firelighter" first proposed by Shackleton inter alia in British Patent Specification No. 589594 and which is conventionally a block of hardened emulsion of aqueous curable resin and combustible liquid. The curable resin component forms on hardening a matrix containing water and the combustible liquid. Typically the combustible liquid is kerosene and the resin is an acid-cured urea formaldehyde resin. Compositions of this type are described in our British Patent Specification No. 1,544,635 and in British Patent Specification No. 1,438,944 which relate particularly to the inclusion of combustible particulate materials in firelighter compositions.

PRIOR ART

French Patent Specification No. 1 480 979—Texaco Development Corporation discloses compositions for use as ignition products for fires or as heaters for such applications as dispelling frost from orchards. The compositions are wax or blends of waxes in solid form prepared by melting the wax(es) and floating on the surface of the molten wax a floatable material such as expanded perlite, vermiculite or glass microspheres to form a crust when the wax(es) has set solid and which acts to limit the area of surface from which volatiles may evaporate and combust during combustion of the wax(es) when the wax surface is liquified. These compositions are not match ignitable and need to be ignited by special means such as by pouring onto an exposed surface crust a quantity of a readily inflammable liquid such as a mixture of iso-octane and kerosene which may be then ignited by means of, e.g. a candle.

"White firelighter" being a rigid structure, in which the rigidity is provided by the resin matrix, acts as a container for a liquid fuel in the form of the droplets of oil-in-water emulsion and is totally different from the abovementioned wax compositions in chemical constitution, method of making and especially physical structure which leads to a distinction in the mechanism of fuel burning. In the Prior Art proposals the composition is no more than a wickless candle with a broad base flame using the localised crust of floatable material as a wick replacement. In white firelighter compositions there is no wick and the fuel vapourises from an emulsion thereof to combust. White firelighter is prepared using emulsion technology and the emulsion is known to be sensitive to incorporation of particulates that have active sites on their surface where emulsion breakdown is initiated.

The incorporation of talc into white firelighter composition is known to lead to protraction of burning time for a standard block weight but there is no concomitant saving in kerosene utilisation. Furthermore, above a certain concentration addition of talc leads to breakdown of the firelighter emulsion prior to setting-up of the resin which precludes the production of a rigid block.

DESCRIPTION OF THE INVENTION

We have now found that inclusion of certain particulate non-combustible solids in white firelighter produces a protraction in burning time per unit volume of composition with concomitant reduction in the volume of kerosene used.

Accordingly the present invention provides an ignitable combustible composition comprising a matrix of solid resin having distributed therethrough combustible liquid, water and up to 25% by weight of a particulate non-combustible solid having a specific surface area of not greater than 8 $m^2/g$.

DETAILED DESCRIPTION OF THE INVENTION

Preferably, the specific surface area is less than 6 $m^2/g$, more preferably less than 4 $m^2/g$ and most preferably within the range of from 1 to 3 $m^2/g$. Materials such as talc which have a specific surface area above 8 $m^2/g$ are not satisfactory as the non-combustible particulate material to be used in accordance with the invention. However the use of further particulate material having a specific surface area exceeding 8 $m^2/g$, e.g. at up to 1.2% and preferably not more than 0.6% by weight of talc (specific surface area about 11 $m^2/g$) in addition to an amount of the material having a specific surface area of 8 $m^2/g$ or less is preferred except in the case of exfoliated vermiculite. The use of larger amounts of talc or other materials having a high specific surface area tends to produce a soft composition, that is one that leaks kerosene, which may be useful in some respects but is not entirely suitable as a firelighter.

The combustible compositions may contain, in addition to the non-combustible particulate material or materials, a proportion of combustible particulate material, e.g. comminuted or granulated peat or wood as described in Specification No. 1,544,635; coaldust as described in Specification No. 1,438,944; seeds such as linseed, rapeseed and millet which may be used whole or crushed, or seed hulls such as coconut husk and peach stones, which are preferably comminuted; or mixtures thereof.

Specific surface areas may suitably be measured by the gas adsorbtion method using nitrogen gas (B.E.T.) Brunauer, Emmett & Teller.

Preferably, the bulk density of the non-combustible solid is low e.g. not greater than 0.4 g/cc, more preferably not greater than 0.1 g/cc and still more preferably not greater than 0.05 g/cc. Examples of materials meeting these requirements are glass microspheres, e.g. FILLITE, having a bulk density of from 0.18 to 0.4 g/cc and a specific surface of 0.2 to 0.3, exfoliated vermiculite typially having a bulk density of from 0.05 to 0.1 g/cc and a specific surface area of about 5.9, expanded perlite typically having a bulk density of from 0.025 to 0.05 g/cc and a specific surface area of from 1.5 to 3.0.

Other suitable materials include sand typically having a bulk density of about 1.1 and a specific surface area of about 0.25 $m^2/g$, diatomaceous earths, e.g. kieselguhr, such as are marketed under the trade name CELITE which is flux calcined with soda ash typically having a bulk density of about 0.2 g/cc, and specific surface area 0.7 to 3.5 $m^2/g$ and unexfoliated or unexpanded materials of igneous origin such as perlite of bulk density typically 1.28 g/cc and vermiculite having bulk density 0.64 to 0.96 g/cc. Exfoliated vermiculite typically has a bulk density of about 0.1 g/cc and a specific surface area of about 6 $m^2/g$.

The use of perlite is more specifically described in our co-pending British Patent application entitled "Combustible Compositions". No. 26914/79 filed on Aug. 2, 1979.

The compositions of the invention may be prepared by mixing the non-combustible particulate material with an aqueous emulsion of combustible liquid curable resin and emulsifying agent, adding a catalyst for the curing of the resin and allowing the mixture to set.

There is some danger of the addition of the particulate material causing partial or total breakdown of the emulsion and the nature and amount of the materail should be chosen to avoid this or to ensure than any emulsion breakdown is not excessive. It is believed that a large specific area in the particulate material can contribute to emulsion breakdown as can as chemically active surface. Large specific surface areas may provide a large number of active sites at which breakdown may be initiated.

It will be noted that the particulate materials which may be used in the present invention may have widely varying surface characteristics on the microscopic scale from smooth (such as glass microspheres) to porous or pitted (e.g. Kieselguhr).

The material preferably has a non-reactive surface which is not markedly acid or alkaline.

The amount of the non-combustible particulate material in the composition may be from 0.1 to 20% by weight especially 0.5–10% but is preferably at least 1.5%.

Preferably, the combustible liquid is a hydrocarbon oil such as kerosene. Other combustible liquids which may be used include combustible oils of mineral origin, such as white spirit and distillate, vegetable origin, such as corn oil and groundnut oil or animal origin such as fish oil and neatsfoot oil. These may also be used in combination with kerosene. The combustible composition may also contain combustible semi-solids such as waxes, e.g. slack wax and these may be dispersed or dissolved in the combustible liquid.

Whilst it is possible to operate the manufacture of white firelighter at slightly elevated temperatures, fire risk and other considerations then make the process hazardous. Therefore, the amount of solid wax of wax-like material that is incorporated into the combustible liquid preferably will not exceed a level beyond which the fluidity of the combustible liquid is impaired.

Roughly up to 60% by weight based on the combustible liquid present of such wax or wax-like material may be incorporated. Preferably, from 20 to 50%w/w based on the weight of combustible liquid present.

The combustible liquid may comprise up to 93% w/w of the final combustible composition and is preferably, not more than 86% w/w of the final composition. Valuable compositions can however be made using from 58 to 75% w/w of combustible liquid when care is given to selecting the non-combustible particulate material and the amount of water in the composition.

The combustible composition may be produced in small pieces by moulding or a combination of moulding and cutting, these pieces being suitable for use as firelighters. Alternatively, the composition may be in larger pieces, or form a part of a composite larger structure intended for use as a fuel, for example in the shape of an artificial firelog.

The compositions of the present invention are generally match ignitable although those compositions in which the water content is high are less easily so-ignited. By adjustment of mixing technique whereby the water and particulate solid combustible material are initially premixed, protracted burn time may be coupled with complete combustion and the match ignitability is enhanced.

The weight ratio of solid particulate material to water may be from 1:84 to 1:3, preferably 1:30 to 1:7 although the optimum ratio will depend on the nature of the particulate material.

In the case of a firelog, it is not necessary that all of the log be match ignitable, it is sufficient to provide a log which is largely non-match ignitable or difficult to light with a match but of which a portion is match ignitable and can act as a firelighter for the remainder. Such a log may be produced by moulding and setting a mixture as described above containing too much water to be match ignitable but having a desirably long burning time, and then moulding in a recess in the log a quantity of a composition according to this invention.

The present invention therefore includes a composite combustible composition comprising a non-match ignitable part having intimately attached thereto a match ignitable composition as described above.

The use of solid particulate material, and any extra water used, may enable the amount of kerosene or other combustible liquid contained in a unit weight of composition to be decreased without the full expected decrease in burning time (proportional to the decrease in kerosene content) and may even extend the burning time despite the decrease in kerosene content.

The resin matrix may be urea-formaldehyde resin, a melamine-formaldehyde resin, a phenol-formaldehyde resin, or a phenol-furfuraldehyde resin. The most commonly used resin for making white firelighter compositions is an acid-cured urea formaldehyde resin used as a mixed precondensate dispersed or dissolved in aqueous medium optionally containing or to be used with extra urea or formaldehyde monomer and/or other known additives.

Broadly, any suitable thermosetting resin such as are discussed above may be used as is known in the art of white firelighter emulsion making. Crude phenols such as cresols may be employed provided a pure white product is not of importance.

Suitable catalysts for the particular resin system chosen are also well-known and are discussed in the published specifications referred to earlier.

The proportion of resin solids employed in the combustible compositions of the present invention is generally within the range 3%w/w to 8%w/w based on final composition.

If a large proportion of solids is employed then it may be desirable to use a relatively large resin content.

The combustible compositions of the present invention are typically produced by preparing an emulsion of combustible liquid in a resin dispersion using a suitable amount of suitable emulsifier. Such an emulsion may then be rapidly admixed with the desired amount of the chosen particulate non-combustible solid, for example in a screw mixer. Catalyst may then be added and the mixture quickly poured into suitable moulds to gel. The moulds may be of size and shape to produce a small block for use as a firelighter without further processing.

Alternatively, large blocks may be moulded for use as firelogs or still larger blocks may be made to be subsequently cut by knives or wires to produce blocks of a size suitable for firelighters or of a bigger size suitable for fuel.

If the particulate non-combustible material is of large particle size it may prove difficult to cut blocks with wires whilst avoiding swarf, equally knives may be blunted rapidly and consequently such compositions are better moulded to the required size for use.

Selected solid combustible materials may be incorporated into the emulsion before, simultaneously with or after adding the particulate non-combustible materials. Suitable selected solid combustible materials include waste white firelighter optionally containing non-combustible granular waxes as part replacement for combustible liquid and the like.

It is thought that the use of porous non-combustible particulate materials such as Celite or other air-containing materials such as hollow glass microspheres may improve the compositions by incorporating air into the composition.

Also the particulate material may act as a wicking agent improving the combustibility of the product and hence allowing more water to be used without losing the ability to light the composition by a match.

The invention will be illustrated by the following Examples.

EXAMPLES

The method and order of mixing used in the following Examples was in each case the same. The resin used in Examples 1–12 was a urea-formaldehyde resin dispersion in water containing 68% solids supplied by Ciba-Geigy as Resin Aerolite FL2 and the emulsifier is an emulsifying agent marketed by Lankro Chemicals Limited under the name Arylan SBC25. In Examples 13–18 inclusive the urea-formaldehyde resin used was a 53% solids aqueous dispersion supplied by Ciba-Geigy and identified as "XDF4024". In Examples 1–12 the catalyst was 1.3 N dilute hydrochloric acid used at a level of 0.5 parts dilute hydrochloric acid per 100 parts of final composition; in Examples 13 to 18 inclusive the same catalyst was employed at a level 0.6 parts per 100 parts of final composition. The emulsifier used was the same in all Examples. For convenience the acid has been included with the total water content in the table.

The appropriate amount of resin dispersion was diluted with water containing the emulsifier dissolved therein and the whole stirred whilst the kerosene was added to form an oil-in-water emulsion in known manner. An appropriate amount as indicated in the tables of particulate solid material was gently stirred into the emulsion. When the mixture was uniform catalyst was added with vigorous stirring and the block moulded immediately in a standard mould from which fingers of firelighter were cut by dividing the block into 12 equal parts.

The finger weight and burning time were noted in each case.

| Example No. | 1 | 2 | 3 | 4 | 5 | 6 |
|---|---|---|---|---|---|---|
| Kerosene % | 56 | 70.88 | 75.88 | 75.88 | 78.88 | 75 |
| Total water (+Acid) % | 13.07 | 14.38 | 14.72 | 14.72 | 14.37 | 15.6 |
| Resin solids % | 5.1 | 3.98 | 3.63 | 3.63 | 3.98 | 4.1 |
| Emulsifier solids % | 0.17 | 0.17 | 0.17 | 0.17 | 0.17 | 0.17 |
| Talc % | 0.6 | 0.6 | 0.6 | 0.6 | 0.6 | 0.6 |
| Fillite % | 25.00 | | | | | |
| Vermiculite % | | 10.00 | | | | |
| Sand (XPF3) % | | | 5.0 | | | 5.0 |
| Bleached white sand (XP3) % | | | | 5.0 | | |
| Celite 545 % | | | | | 2.0 | |
| Finger weight (g) | 30.75 | 21.00 | 37.2 | 36.9 | 37.1 | 34.7 |
| Burn time (minutes-seconds) | 9–30 | 13–58 | 17–35 | 19–30 | 25–13 | 21–10 |
| Burn time / wt of Kerosene in finger | 0.55 | 0.94 | 0.62 | 0.7 | 0.86 | 0.632 |

-continued

| Example No. | 7 | 8 | 9 | 10 | 11 | 12 |
|---|---|---|---|---|---|---|
| Kerosene % | 75 | 71 | 77 | 78.88 | 77 | 77 |
| Total water (+Acid) % | 15.6 | 14.7 | 16 | 14.37 | 16 | 16 |
| Resin Solids % | 4.1 | 3.9 | 4.2 | 3.98 | 4.2 | 4.2 |
| Emulsifier solids % | 0.17 | 0.16 | 0.17 | 0.17 | 0.17 | 0.17 |
| Talc % | 0.6 | 0.6 | 0.6 | 0.6 | 0.6 | 0.6 |
| Fillite % | | | | | 2 | |
| Vermiculite % | | 10 | 2 | | | |
| Sand (XPF3) % | | | | | | |
| Bleached white sand (XP3) % | 5.0 | | | | | |
| Celite 545 % | | | | 2 | | |
| Finger weight (g) | 32.7 | 21 | 34.9 | 37.1 | 38.4 | 39.6 |
| Burn time (minutes-seconds) | 20–50 | 13–58 | 17–29 | 25–13 | 13–30 | 17–21 |
| Burn time / wt of Kerosene in finger | 0.707 | 0.95 | 0.61 | 0.86 | 0.46 | 0.56 |
| Perlite Ore % | | | | | | 2 |

| Example No. | 13A | 13B | 14 | 15 | 16* | 17 | 18 |
|---|---|---|---|---|---|---|---|
| Kerosene % | 6.31 | 61.80 | 77.30 | 73.17 | 74.86 | 78.13 | 79.75 |
| Total water (+Acid) % | 11.10 | 10.64 | 14.05 | 13.06 | 13.54 | 14.13 | 14.42 |
| Resin Solids % | 2.76 | 2.64 | 3.48 | 3.29 | 3.37 | 3.51 | 3.59 |
| Emulsifier solids % | 0.13 | | 0.125 | 0.166 | 0.16 | 0.17 | 0.17 |
| Fillite % | — | — | 5.00 | 10.00 | — | — | — |
| Vermiculite (Exfoliated) % | — | — | — | — | 8 | 4 | 2 |
| Sand (XPF3) % | 24.59 | — | — | — | — | — | — |
| Bleached white sand (XP3) % | — | 24.17 | — | — | — | — | — |
| Finger weight (g) | 46.96 | 44.77 | 39.27 | 35.21 | 30.75 | 35.45 | 38.1 |
| Burn time (minutes) | 12.08 | 12.15 | 13.38 | 12.93 | 15.58 | 14.75 | 13.38 |
| Burn time / wt. of Kerosene in finger | 0.42 | 0.44 | 0.44 | 0.50 | 0.68 | 0.53 | 0.44 |

*The product of Example 16 was not so hard as regular white firelighter.

In the Examples, the burn time was measured by laying an oblong finger of composition on a grid on a tripod and lighting one corner with a match. The burning time taken was the total time from lighting to spontaneous extinguishing.

Tests have revealed that with at least some of the particulate solid non-combustible materials the burn time of compositions in accordance with the present invention with a high water content overall exhibit protracted burn times as compared with similar compositions lacking the particulate solid non-combustible materials.

At the lower water concentrations there may be little if any difference in increase of burn time in some cases; the addition of particulate solid non-combustible material and water is at the expense of kerosene content and it is surprising that in such cases the burn time is unaffected. It should be stressed that it may become increasingly difficult to light blocks with a match at very high water contents but as mentioned earlier this can be enhanced by initially premixing the particulate solid with at least a part of the water.

It was generally observed that those samples producing the best results left after burning a more or less self-supporting matrix whereas poorer samples tended to shrink on burning.

Firelighter blocks of the present invention have been found to be no less effective in lighting the bulk of fuels to make fires on a hearth than are the best of previously known firelighters and in a majority of cases there is a distinct improvement in utilisation.

I claim:

1. An ignitable combustible composition comprising a matrix of solid resin having distributed therethrough combustible liquid, water and up to 25% by weight of a particulate non-combustible solid having a specific surface area of not greater than 8 $m^2/g$.

2. A combustible composition as claimed in claim 1, wherein the particulate non-combustible solid has a specific surface area of not greater than 6 $m^2/g$.

3. A combustible composition as claimed in claim 1, wherein the particulate non-combustible material has a bulk density of not greater than 1.2 g/cc.

4. A combustible composition as claimed in claim 1, wherein the non-combustible material is selected from the group consisting of vermiculite, expanded vermiculite, sand, glass microspheres, and diatomaceous earth.

5. A combustible composition as claimed in claim 1, containing from 0.1 to 20% by weight of non-combustible particulate material.

6. A combustible composition as claimed in claim 1, containing from 14 to 20% by weight of water.

7. A combustible composition as claimed in claim 1, wherein the combustible liquid comprises kerosene.

8. A combustible composition as claimed in claim 1, comprising a further particulate material having a specific surface area of more than 8 $m^2/g$.

9. A process for producing a combustible composition as claimed in claim 1 which process comprises mixing a non-combustible particulate material as defined in claim 1 with an aqueous emulsion of combustible liquid, curable resin and emulsifying agent, adding a catalyst for the curing of the resin and allowing the mixture to set.

10. A composite combustible composition comprising a body of non-match ignitable combustible material having intimately attached thereto a portion of a match ignitable composition as claimed in claim 1.

* * * * *